US009763297B2

(12) United States Patent
Hu

(10) Patent No.: US 9,763,297 B2
(45) Date of Patent: Sep. 12, 2017

(54) LIGHTING APPARATUS AND METHODS USING OSCILLATOR-BASED DIMMING CONTROL

(71) Applicant: Cree, Inc., Durham, NC (US)

(72) Inventor: Yuequan Hu, Morrisville, NC (US)

(73) Assignee: Cree, Inc., Durham, NC (US)

( * ) Notice: Subject to any disclaimer, the term of this patent is extended or adjusted under 35 U.S.C. 154(b) by 732 days.

(21) Appl. No.: 13/667,463

(22) Filed: Nov. 2, 2012

(65) Prior Publication Data

US 2014/0125248 A1 May 8, 2014

(51) Int. Cl.
*H05B 33/08* (2006.01)

(52) U.S. Cl.
CPC ..... *H05B 33/0818* (2013.01)

(58) Field of Classification Search
CPC ..... H05B 33/0815; H05B 33/0824; H05B 33/083; H05B 33/0842; H05B 33/0854; H02M 1/4225; H02M 2001/0012; H02M 2003/1586
See application file for complete search history.

(56) References Cited

U.S. PATENT DOCUMENTS 8,581,520 B1 * 11/2013 Wray ..... H05B 33/0842 315/299
2009/0195168 A1 * 8/2009 Greenfeld ..... H05B 33/0815 315/192
2011/0140620 A1 * 6/2011 Lin ..... H05B 37/0263 315/224
2011/0204802 A1 * 8/2011 Welten ..... H05B 33/083 315/193
2012/0119650 A1 * 5/2012 Lee ..... H02M 1/4225 315/122
2012/0187997 A1 * 7/2012 Liao ..... H05B 33/0854 327/299
2013/0015768 A1 * 1/2013 Roberts ..... H05B 33/0815 315/122

* cited by examiner

*Primary Examiner* — Monica C King
(74) *Attorney, Agent, or Firm* — Myers Bigel, P.A.

(57) ABSTRACT

An apparatus includes a driver circuit configured to control a current through at least one LED responsive to a control signal. The apparatus further includes a modulated oscillator circuit configured to modulate an oscillating signal responsive to a dimming signal and to generate the control signal responsive to the modulated oscillating signal.

15 Claims, 7 Drawing Sheets

LIGHTING APPARATUS AND METHODS USING OSCILLATOR-BASED DIMMING CONTROL

FIELD

The present inventive subject matter relates to lighting apparatus and methods and, more particularly, to solid-state lighting apparatus and methods.

BACKGROUND

Solid-state lighting arrays are used for a number of lighting applications. For example, solid-state lighting panels including arrays of solid-state light emitting devices have been used as direct illumination sources in architectural and/or accent lighting. A solid-state light emitting device may include, for example, a packaged light emitting device including one or more light emitting diodes (LEDs), which may include inorganic LEDs, which may include semiconductor layers forming p-n junctions and/or organic LEDs (OLEDs), which may include organic light emission layers.

Solid-state lighting devices are also used in lighting fixtures, such as incandescent bulb replacement applications, task lighting, recessed light fixtures and the like. For example, Cree, Inc. produces a variety of recessed downlights, such as the LR-6 and CR-6, which use LEDs for illumination. Solid-state lighting panels are also commonly used as backlights for small liquid crystal display (LCD) screens, such as LCD display screens used in portable electronic devices, and for larger displays, such as LCD television displays.

LEDs can be dimmed using, for example, linear dimming or pulse-width modulated (PWM) dimming, In a typical LED lighting apparatus, a microcontroller generates a PWM signal that is provided to a driver circuit that controls current passing through one or more LEDs. By varying the duty cycle of the PWM signal, the average current of the LEDs is proportionally changed, and the brightness of the LEDs varies accordingly. The PWM dimming control generally exhibits low appreciable color shift, and thus is widely used.

Some conventional microcontroller-based dimming controllers implement linear dimming. Typically, the microcontroller samples a dimming control signal (e.g., from a commercial dimmer) and generates a PWM signal with its duty cycle varying with the dimming control signal. The PWM signal may be filtered with a low-pass filter, producing a DC voltage that is used to control a power stage of the driver circuit to adjust the LED current.

SUMMARY

Some embodiments provide an apparatus including a driver circuit configured to control a current through at least one LED responsive to a control signal. The apparatus further includes a modulated oscillator circuit configured to generate and modulate an oscillating signal responsive to a dimming signal and to generate the control signal responsive to the modulated oscillating signal.

The modulated oscillator circuit may be configured to pulse width modulate the oscillating signal responsive to the dimming signal. The driver circuit may be configured to control the current through the at least one LED responsive to the pulse-width modulated oscillating signal. In further embodiments, the modulated oscillator circuit may include a filter configured to generate a voltage from the pulse-width modulated oscillating signal and the control signal may include the voltage.

In some embodiments, the modulated oscillator circuit may include a sawtooth generator circuit configured to generate a sawtooth signal and a comparator configured to generate the pulse width modulated oscillating signal based on a comparison of the dimming signal to the sawtooth signal.

According to additional embodiments, the modulated oscillator circuit may be configured to amplitude modulate the oscillating signal responsive to the dimming signal. In some embodiments, the modulated oscillator circuit may include a forward converter configured to generate a voltage responsive to the dimming signal and the control signal comprises the voltage.

In some embodiments, the modulated oscillator circuit may be configured to galvanically isolate the control signal from the dimming signal. For example, the modulated oscillator circuit may be configured to galvanically isolate the control signal from the dimming signal using an opto-isolator or a transformer.

In some embodiments, the driver circuit comprises an AC/DC converter, a DC/DC converter or a buck converter configured to control the current through the at least one LED responsive to the control signal. The dimming signal may include a voltage signal, such as a dimming signal produced by a commercial dimmer or occupancy sensor.

Further embodiments provide apparatus as described above coupled to at least one LED.

Additional embodiments provide methods of controlling a lighting apparatus. The methods include modulating an oscillating signal responsive to a dimming signal and controlling a current through at least one LED responsive to the modulated oscillating signal. Modulating an oscillating signal responsive to a dimming signal may include pulse width modulating the oscillating signal responsive to the dimming signal. Controlling a current through at least one LED responsive to the modulated oscillating signal may include filtering the pulse-width modulated signal to generate an voltage and controlling the current through the at least one LED responsive to the voltage. Pulse width modulating the oscillating signal responsive to the dimming signal may include comparing a sawtooth signal to the dimming signal to generate the pulse width modulated oscillating signal.

In further embodiments, modulating an oscillating signal responsive to a dimming signal may include amplitude modulating the oscillating signal responsive to the dimming signal. Controlling a current through at least one LED responsive to the modulated oscillating signal may include generating a control signal from the modulated oscillating signal and controlling the current through the at least one LED responsive to the control signal, wherein the control signal is galvanically isolated from the dimming signal.

BRIEF DESCRIPTION OF THE DRAWINGS

The accompanying drawings, which are included to provide a further understanding of the inventive subject matter and are incorporated in and constitute a part of this application, illustrate certain embodiment(s) of the inventive subject matter. In the drawings.

DETAILED DESCRIPTION

Figure 1:
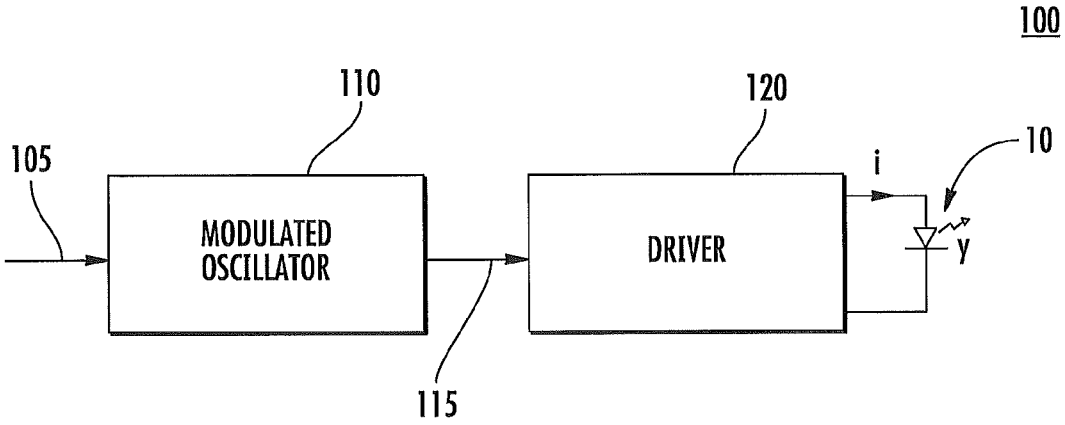
FIG. 1 is a schematic block diagram illustrating an apparatus according to some embodiments.

Embodiments of the present inventive subject matter now will be described more fully hereinafter with reference to the accompanying drawings, in which embodiments of the inventive subject matter are shown. This inventive subject matter may, however, be embodied in many different forms and should not be construed as limited to the embodiments set forth herein. Rather, these embodiments are provided so that this disclosure will be thorough and complete, and will fully convey the scope of the inventive subject matter to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. It will be further understood that elements "coupled in series" or "serially connected" may be directly coupled or may be coupled via intervening elements.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item.

The expression "lighting apparatus", as used herein, is not limited, except that it indicates that the device is capable of emitting light. That is, a lighting apparatus can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device. The present inventive subject matter may further relate to an illuminated enclosure (the volume of which can be illuminated uniformly or non-uniformly), comprising an enclosed space and at least one lighting apparatus according to the present inventive subject matter, wherein the lighting apparatus illuminates at least a portion of the enclosed space (uniformly or non-uniformly).

FIG. 1 illustrates a lighting apparatus 100 according to some embodiments of the inventive subject matter. The apparatus 100 includes at least one LED 10 driven by a driver circuit 120 that controls a current i passing through the at least one LED 10. The at least one LED may include a single LED or a plurality of LEDs connected in a serial and/or parallel manner. The driver circuit 120 controls the current i responsive to a control signal 115. In various embodiments, the control signal 115 may take any of a number of different forms including, but not limited to, a pulse width modulated (PWM) signal, an amplitude modulated signal and/or a voltage. As shown, the control signal 115 is generated by a modulated oscillator circuit 110, which modulates an oscillating signal responsive to a dimming signal 105 (e.g., a voltage). In various embodiments, the control signal 115 may be the modulated oscillating signal or a signal derived therefrom. It will be appreciated that the modulated oscillator circuit 110 may be implemented using analog circuitry, digital circuitry or combinations of analog and digital circuitry.

Figure 2:
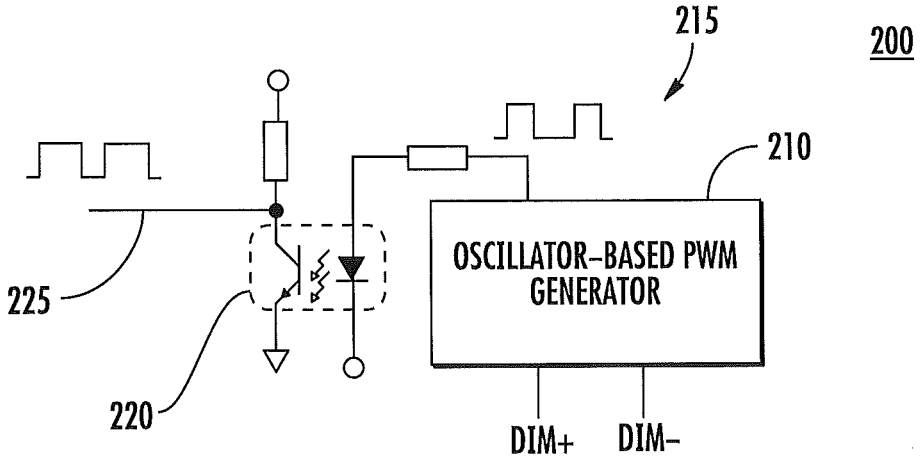
FIGS. 2-7 are schematic block diagrams illustrating different modulated oscillator circuits for the apparatus of FIG. 1 according to various embodiments.

FIGS. 2-5 illustrate various types of modulated oscillator circuits according to some embodiments. FIG. 2 illustrates an optically isolated modulated oscillator circuit 200. The modulated oscillator circuit 200 includes an oscillator-based PWM circuit 210, which produces a pulse-width modulated (PWM) signal 215 that has a duty cycle that is dependent upon a dimming signal DIM+/DIM−. The PWM signal 215 is provided to an input of an opto-coupler 220. A corresponding isolated PWM control signal 225 is produced at an output of the opto-coupler 220. The isolated PWM control signal 225 may be provided to a PWM-based LED driver circuit that controls current through one or more LEDs responsive to a duty cycle of the PWM control signal 225.

Figure 3:
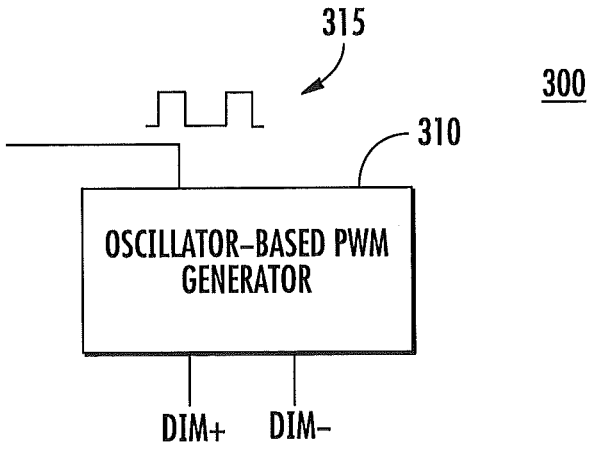

FIG. 3 shows a non-isolated modulated oscillator circuit 300 according to some embodiments. The modulated oscillator circuit 300 includes an oscillator-based PWM circuit 310, which produces a PWM control signal 315 that can be provided to a PWM-based LED driver circuit, without the isolation provided by the circuit of FIG. 2.

Figure 4:
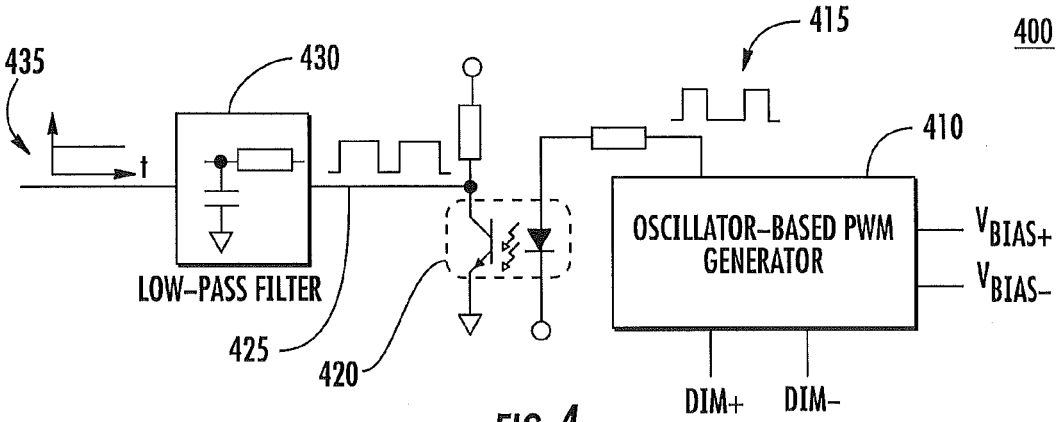

According to further embodiments, a modulated oscillator circuit may provide a control signal in the form of a voltage derived from a PWM signal. FIG. 4 illustrates an optically isolated modulated oscillator circuit 400. The modulated oscillator circuit 400 includes an oscillator-based PWM circuit 410, which produces a pulse-width modulated (PWM) signal 415 that has a duty cycle that is dependent upon a dimming signal DIM+/DIM−. The PWM signal 415 is provided to an input of an opto-coupler 420. A corresponding isolated PWM control signal 425 is produced at an output of the opto-coupler 420. The isolated PWM control signal 425 is provided to a low-pass filter 430, which produces a voltage 435 that may be provided to a driver circuit that controls current through one or more LEDs responsive to the voltage 435.

Figure 5:
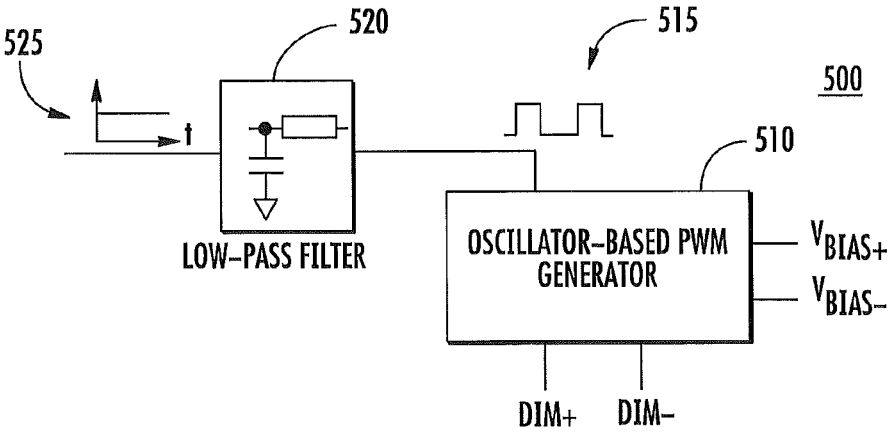

FIG. 5 shows a non-isolated modulated oscillator circuit 500 according to some embodiments. The modulated oscillator circuit 500 includes an oscillator-based PWM circuit 510, which produces a PWM control signal 515 that is provided to a low-pass filter 520, without the isolation provided by the circuit of FIG. 4. A voltage 525 produce by the filter 520 may be provided to an LED driver circuit.

Figure 6:
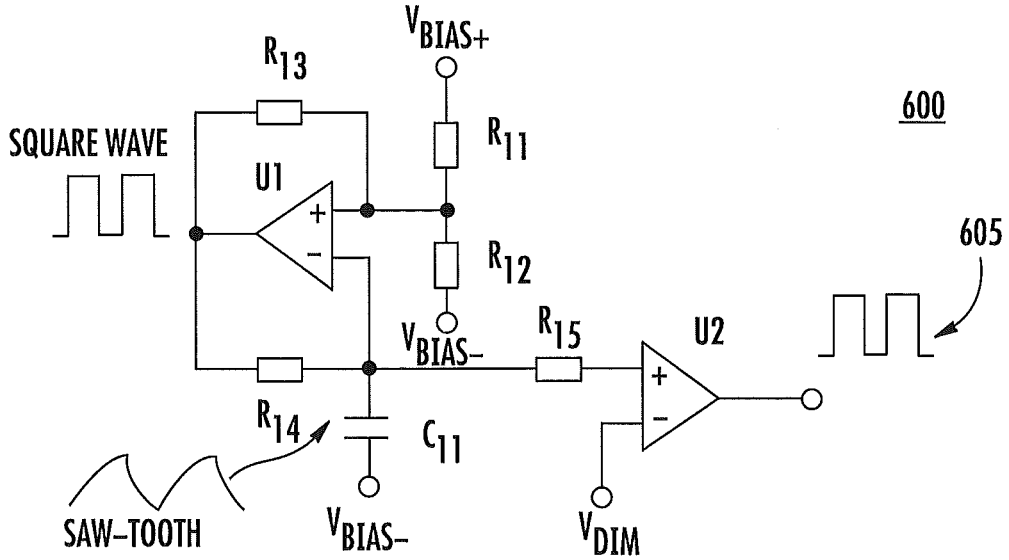

FIG. 6 illustrates an analog oscillator circuit 600 that produces a PWM control signal 605 that is pulse-width modulated at a duty cycle correlated with a dimming signal $V_{DIM}$. The oscillator circuit 600 includes a first comparator U1 that has a first input coupled to a voltage divider including resistors R11 and R12 that are connected in series between two bias voltage nodes $V_{BIAS+}$ and $V_{BIAS-}$. The first input of the first comparator U1 is also coupled to its output by a feedback resistor R13. A second input of the first comparator U1 is coupled to a node at which a sawtooth signal is generated using an integrator comprising a resistor R14 and a capacitor C11. When the sawtooth signal exceeds the voltage of the output of the voltage divider, the output of the first comparator U1 is driven low, causing the integrator to reset.

The sawtooth signal is provided to a first input of a second comparator U2 via a resistor R15. A second input of the second comparator U2 receives the dimming signal $V_{DIM}$. The second comparator U2 produces the PWM control signal 605 responsive to a comparison of the sawtooth signal to the dimming signal $V_{DIM}$. The dimming signal $V_{DIM}$ may be received, for example, from a voltage source or a 0-10V commercially available dimmer.

FIGS. 2 and 4 illustrate circuits that provide galvanic isolation using opto-couplers, but it will be appreciated that galvanic isolation may also be provided using magnetic coupling through a transformer or similar device. FIGS. 4 and 5 illustrate generating current control voltages using pulse-width modulation, but it will be appreciated that amplitude and/or other types of modulation may be used to similar effect.

Figure 7:
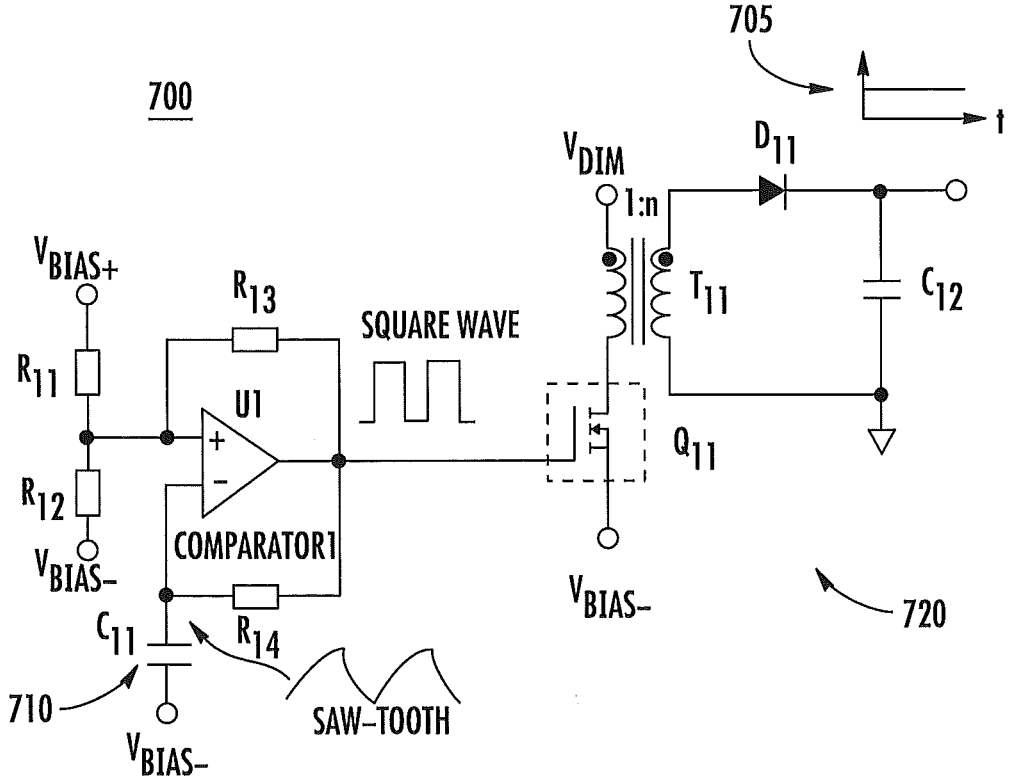

FIG. 7 illustrates a modulated analog oscillator circuit 700 that uses magnetic isolation and amplitude modulation according to some embodiments. The modulated oscillator circuit 700 includes a square wave generator 710 that includes a comparator U1, resistors R11, R12, R13 and R14 and a capacitor C11, which operate in the manner described above with reference to FIG. 6. A square wave output from the comparator U1 drives the gate of a transistor Q11, which is coupled in series with a primary winding of a transformer T11 of a forward converter 720. A voltage imposed on the primary winding is dependent on a dimming signal $V_{DIM}$, which may be received, for example, from a voltage source or a 0-10V commercially available dimmer. The magnitude of a corresponding voltage induced on the secondary winding of the transformer T11 is proportional to the dimming signal $V_{DIM}$. This voltage is rectified by a diode D11, causing an output capacitor C12 of the forward converter 720 to be charged to a voltage that is proportional to the dimming signal $V_{DIM}$, thus producing a control signal 705 in the form of an analog voltage.

Figure 8:
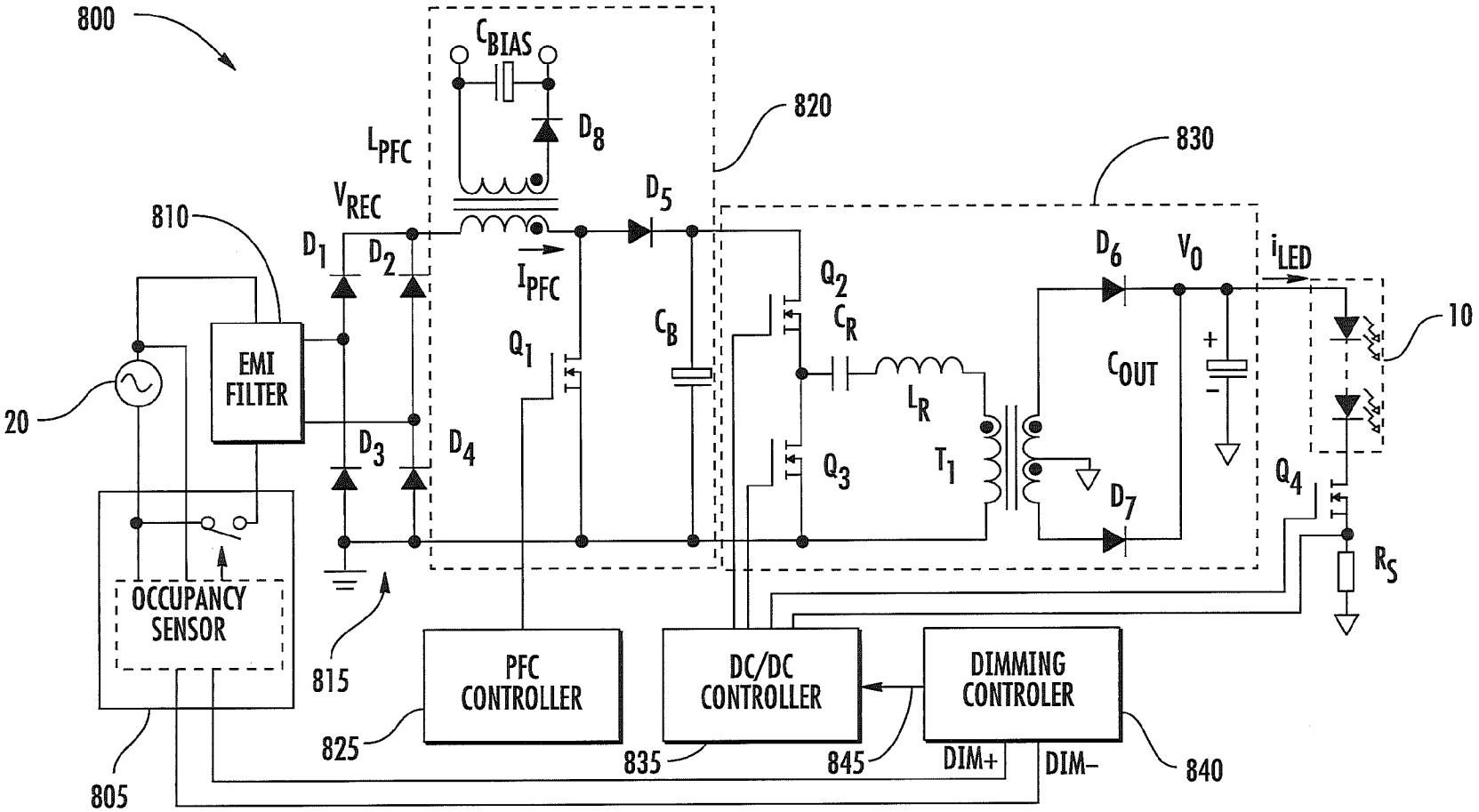
FIGS. 8-11 are schematic block diagrams illustrating lighting apparatus according to various embodiments.

An example of an LED lighting apparatus 800 powered by a two-stage driver with a modulated oscillator circuit according to some embodiments is shown in FIG. 8. The apparatus 800 includes an occupancy sensor 805 that detects a presence and responsively generates a dimming signal DIM+/DIM−. The apparatus 800 further includes an EMI filter 810 at an input of a rectifier 815 including diodes D1, D2, D3 and D4.

A boost power factor correction (PFC) circuit 820 is coupled to the output of the rectifier 815. The PFC circuit 820 includes an inductor $L_{PFC}$ and a transistor Q1, which is controlled by a PFC controller 825. The PFC circuit 820 also includes a bias capacitor $C_{BIAS}$, an output capacitor $C_B$ and diodes D5 and D8.

A resonant type DC/DC converter 830 is coupled to the output of the PFC circuit 820. The DC/DC controller 820 includes transistor switches $Q_2$ and $Q_3$, a resonant capacitor $C_r$, a resonant inductor $L_r$, a transformer $T_1$, diodes $D_6$ and $D_7$, and an output capacitor $C_{OUT}$. The DC/DC converter 830 is an LLC resonant converter, with zero-voltage turn-on of the transistor switches $Q_2$ and $Q_3$, and zero-current turn-off of the diodes $D_6$ and $D_7$ when the operating frequency is lower than the resonant frequency determined by $L_r$ and $C_r$. An LLC converter can provide high efficiency and low EMI (Electro-magnetic Interference). The DC/DC converter 830 is coupled to a string 10 of LEDs, producing an output voltage $V_0$ and current $i_{LED}$. The DC/DC converter 830 is controlled by a DC/DC controller 835, which drives the transistors Q2 and Q3. The DC/DC converter 830 can have other configurations, such as a flyback (voltage step down or up) converter or a buck (voltage step-down) converter.

A transistor switch $Q_4$ serves as a protection switch. When there is a short circuit or over current, or an over-voltage of the output, the transistor $Q_4$ is turned off to protect the driver circuit and the LED load. A resistor $R_s$ senses the LED current, and the DC/DC controller 835 uses the sensed current signal to provide current regulation of the LED load 10 and protect the DC/DC converter 830 during fault conditions.

A dimming controller 840 provides a current control signal 845 to the DC/DC controller 835, which responsively controls the DC/DC converter 830 to control the LED current $i_{LED}$. The dimming controller 840 generates the current control signal 845 responsive to the dimming signal DIM+/DIM− generated by the occupancy sensor 805. The dimming controller 840 may be a modulated oscillator circuit similar, for example, to the circuits of FIGS. 1-7.

Such a dimming controller may also be connected to user-controlled dimmer, such as a commercial 0-10V dimmer. The LED current hence the LED brightness is adjusted based on the voltage appearing between DIM+and DIM−. For example, the LED current may be at a maximum level that provides full brightness when the voltage between DIM+ and DIM− is 10 V, whereas the LED current is half the maximum preset current and the brightness is half the full brightness when the voltage between DIM+ and DIM− is 5 V.

Figure 9:
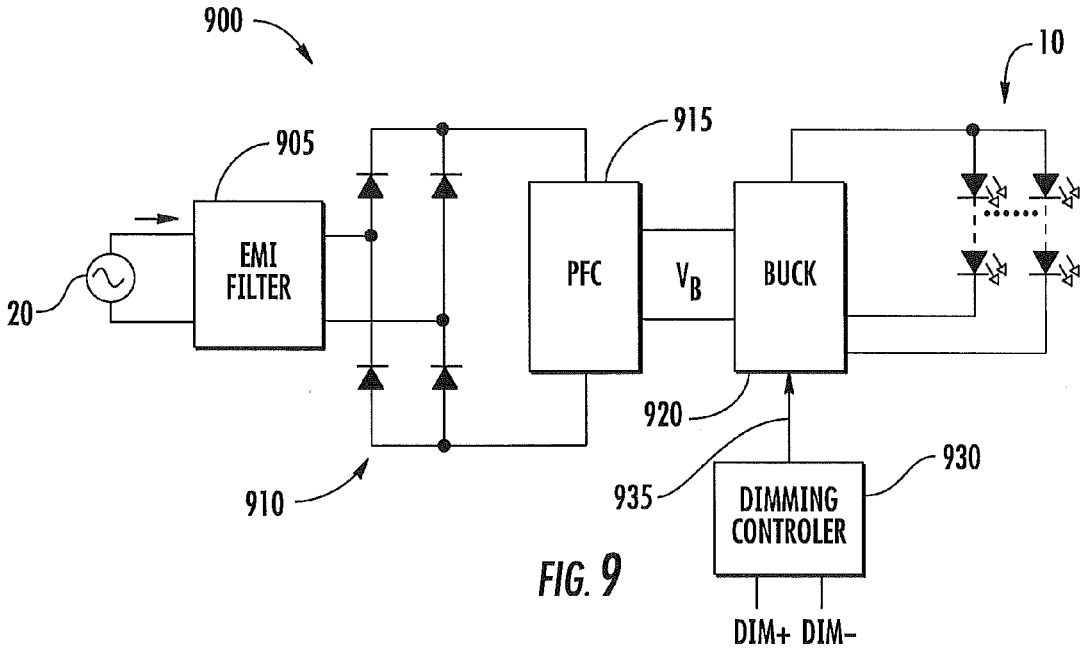

FIG. 9 shows a lighting apparatus 900, another implementation of a two-stage LED driver with an EMI filter 905, a rectifier 910, a PFC (isolated or non-isolated) circuit 915 and a buck converter 920. The buck converter 920 provides a constant driving current for a parallel combination of LED strings 10, adjusting the LED current level based on a current control signal 935 generated by a dimming controller 930. The dimming controller 930 generates the current control signal 935 using an oscillating signal that is modulated responsive to a dimming signal DIM+/DIM−. The dimming controller 930 may be a modulated oscillator circuit similar, for example, to the circuits of FIGS. 1-7.

Figure 10:
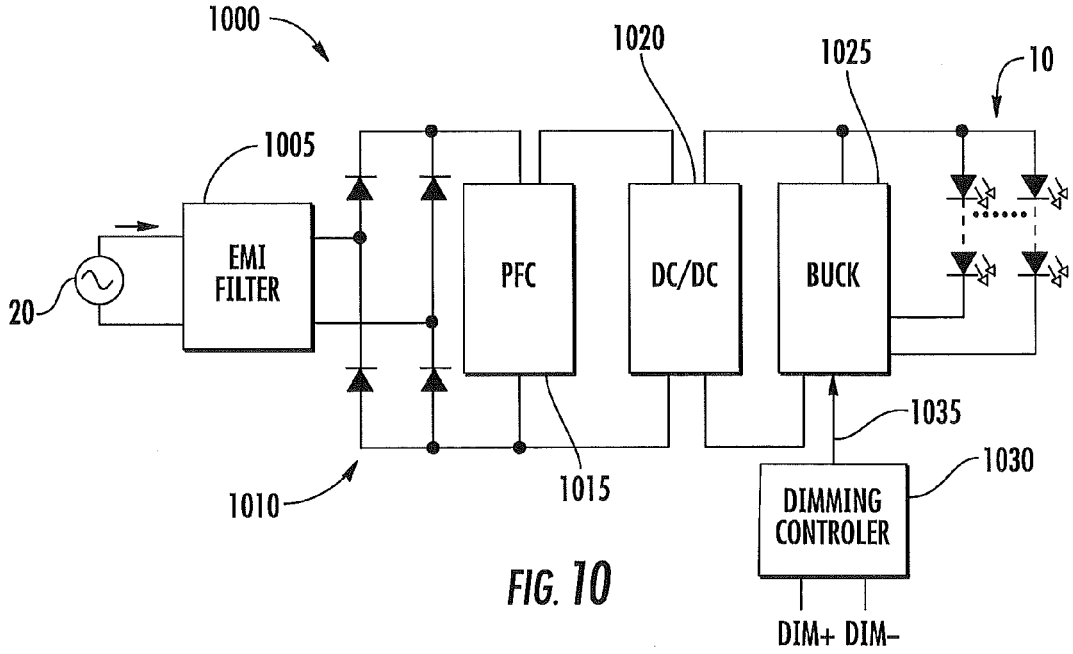

FIG. 10 shows further embodiments in a lighting apparatus 1000 with a three-stage LED driver including an input EMI filter 1005, a rectifier 1010, a PFC circuit 1015, a DC/DC converter 1020 and a buck converter 1025. The buck converter 1025 regulates a driving current for each of a plurality of LED strings 10 based on a current control signal 1035 generated by a dimming controller 1030. The dimming controller 1030 generates the current control signal 1035 using an oscillating signal that is modulated responsive to a dimming signal DIM+/DIM−. The dimming controller 1030 may be a modulated oscillator circuit similar, for example, to the circuits of FIGS. 1-7.

Figure 11:
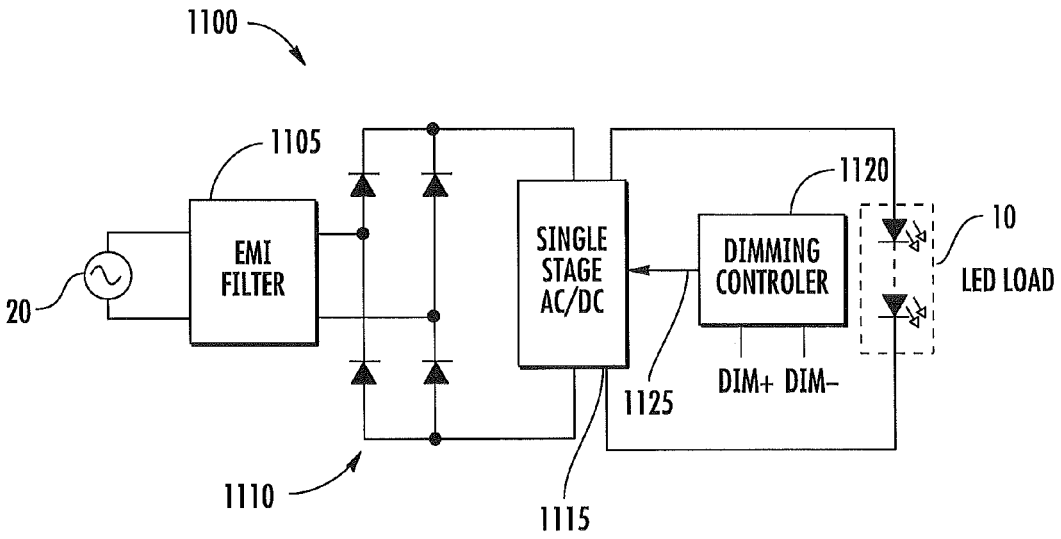

FIG. 11 illustrates a lighting apparatus 1100 with a single-stage LED driver with a dimming controller according to some embodiments of the inventive subject matter. The driver includes an EMI filter 1105, a rectifier 1110, and a single state AC/DC converter 1115. A current provided to an LED load 10 by the AC/DC converter 1115 is controlled responsive to a current control signal 1125 generated by a dimming controller 1120. The current control signal 1125 is generated responsive to a dimming signal DIM+/DIM−. The dimming controller 1120 may be a modulated oscillator circuit similar, for example, to the circuits of FIGS. 1-7.

In the drawings and specification, there have been disclosed typical embodiments of the inventive subject matter and, although specific terms are employed, they are used in a generic and descriptive sense only and not for purposes of limitation, the scope of the inventive subject matter being set forth in the following claims.

What is claimed is:

1. An apparatus comprising:

a driver circuit comprising a converter configured to apply a voltage to at least one LED and a current regulator circuit configured to regulate a current provided by the converter by driving a gate of a switching device of the converter responsive to both a control signal that is based on a dimming signal and a sensed current signal representing a current through the at least one LED; and a modulated oscillator circuit configured to modulate an oscillating signal responsive to the dimming signal and to generate the control signal provided to the current regulator circuit responsive to the modulated oscillating signal and responsive to the dimming signal.

2. The apparatus of claim 1, wherein the modulated oscillator circuit is configured to pulse width modulate the oscillating signal responsive to the dimming signal.

3. The apparatus of claim 2, wherein the driver circuit is configured to control a switching frequency of the switching device of the converter responsive to the pulse-width modulated oscillating signal.

4. The apparatus of claim 3, wherein the modulated oscillator circuit comprises a filter configured to generate a control voltage from the pulse-width modulated oscillating signal and wherein the control signal comprises the control voltage.

5. The apparatus of claim 2, wherein the modulated oscillator circuit comprises:

a sawtooth generator circuit configured to generate a sawtooth signal; and a comparator configured to generate the pulse width modulated oscillating signal based on a comparison of the dimming signal to the sawtooth signal.

6. The apparatus of claim 1, wherein the converter comprises an AC/DC converter, a DC/DC converter or a buck converter.

7. The apparatus of claim 1, wherein the dimming signal comprises a voltage signal.

8. A lighting device comprising the apparatus of claim 1 coupled to at least one LED.

9. A method of controlling a lighting apparatus, the method comprising:

modulating an oscillating signal responsive to a dimming signal; and regulating a current provided by a converter that applies a voltage to at least one LED by driving a gate of a switching device of the converter responsive to both the modulated oscillating signal that is based on the dimming, signal and a sensed current signal representing a current through the at least one LED.

10. The method of claim 9, wherein modulating an oscillating signal responsive to a dimming signal comprises pulse width modulating the oscillating signal responsive to the dimming signal.

11. The method of claim 10, wherein regulating a current provided by a convener that applies a voltage to at least one LED responsive to the modulated oscillating signal and a sensed current signal representing a current through the at least one LED comprises filtering the pulse-width modulated signal to generate an voltage and controlling the convener that applies a voltage to the at least one LED responsive to the voltage.

12. The method of claim 10, wherein pulse width modulating the oscillating signal responsive to the dimming signal comprises comparing a sawtooth signal to the dimming signal to generate the pulse width modulated oscillating signal.

13. The method of claim 9, wherein regulating a current provided by a converter that applies a voltage to at least one LED responsive to the modulated oscillating signal comprises generating a control signal from the modulated oscillating signal and controlling a switching frequency of the switching device of the converter responsive to the control signal, wherein the control signal is galvanically isolated from the dimming signal.

14. The method of claim 9, wherein regulating a current provided by a converter that applies a voltage to least one LED responsive to the modulated oscillating signal comprises controlling an AC/DC converter, a DC/DC converter or a buck converter.

15. An apparatus comprising:

a modulated oscillator circuit configured to modulate an oscillating signal responsive to a dimming signal and to generate a control signal that is separate from the modulating oscillating signal, wherein the control signal is responsive to both the modulated oscillating signal and the dimming signal;

a converter that is configured to supply a current to at least one LED, wherein the converter comprises at least one switching device; and a current controller coupled to the converter and the modulated oscillator circuit, wherein the current controller is configured to receive as an input the control signal generated by the modulated oscillating circuit and a sensed current signal representing the current through the at least one LED, wherein the current controller is configured to output a switching signal to the at least one switching device of the converter responsive to the control signal, and wherein the converter is configured to control the current supplied to the at least one LED responsive to the switching signal.

* * * * *